United States Patent [19]

Furutsu

[11] 4,417,682

[45] Nov. 29, 1983

[54] TAG ATTACHING MACHINE

[75] Inventor: Akira Furutsu, Tokyo, Japan

[73] Assignees: Japan Bano'k Co., Ltd., Tokyo, Japan; Ben Clements & Sons, Inc., South Hackensack, N.J.

[21] Appl. No.: 313,713

[22] Filed: Oct. 21, 1981

[30] Foreign Application Priority Data

Oct. 24, 1980 [JP] Japan ..... 55-148172

[51] Int. Cl.[3] ..... B65C 5/06; B65C 7/00

[52] U.S. Cl. ..... 227/67; 227/76; 227/136

[58] Field of Search ..... 29/739; 227/67, 76, 227/136, 156

[56] References Cited

U.S. PATENT DOCUMENTS 3,650,452 3/1972 Finke ..... 227/76 X 3,840,167 10/1974 Otteman et al. ..... 227/76

4,186,862 2/1980 Klaus ..... 227/156 X

*Primary Examiner*—Mark Rosenbaum

*Attorney, Agent, or Firm*—Blum, Kaplan, Friedman, Silberman & Beran

[57] ABSTRACT

A tag attaching device having a guide groove for receiving and guiding a tag pin assembly. The device has a cutting edge and a pressing member disposed to oppose to each other across the guide groove. The pressing member is adapted to press the portion of the connecting bar from which tag pins have been severed against the cutting edge to cut that portion of the connecting bar to avoid various troubles which might otherwise be caused by the projection of the connecting bar, such as damaging of the goods to which tag pins are attached.

2 Claims, 13 Drawing Figures

TAG ATTACHING MACHINE

BACKGROUND OF THE INVENTION

1. Field of the Invention

The present invention relates to a tag attaching device having a function to cut and remove the connecting bar of a tag pin assembly after the severance or separation of individual tag pins.

2. Description of the Prior Art

It is well known to use tag pins for securing price tags, labels or the like to goods such as garments. These tag pins are individually constituted by a head portion, a lateral bar and a filament portion interconnecting the head portion and the lateral bar. Usually, tag pins are formed as a tag pin assembly in which a large number of pins are connected to a common connecting bar through their joint portions in a comb-like form. The comb-like tag pin assembly is usually formed from a synthetic resin such as nylon, polypropylene or the like.

The attaching of a tag to an object such as a garment with use of a tag pin is made by means of a tag attaching device. Namely, after inserting a tag pin assembly into a guide groove of a tag attaching device, a hollow needle with a longitudinal slot is driven to penetrate a price label or the like and the object. Then, as a lever of the tag attaching device is pulled, a first one of the tag pins is severed from the tag pin assembly and the lateral bar of the severed tag pin is slided in the hollow needle to reach the back side of the object so as to be retained by the object together with the price label.

As tag pins are severed successively from the connecting bar, the connecting bar portion now having no tag pin is gradually projected to the lower side of the guide groove of the tag attaching device. This connecting bar portion has a number of short thorns formed as a result of breakage of the joint portions through which the tag pins have been connected to the connecting bar. It is often experienced that, as the projected connecting bar portion contacts the garment, the thorns are caught by the yarns of the garment to cause a cutting of the yarn, fray and other troubles.

For this reason, it has been necessary to pay a specific attention to avoid damaging of the object by the connecting bar after severance of the tag pins, in attaching tags or the like to the objects by the conventional tag attaching device.

OBJECTS OF THE INVENTION

Accordingly, an object of the invention is to provide a tag attaching device having a function to cut and remove a portion of the connecting bar of the tag pin assembly after the severance of the tag pins.

Other objects and features of the invention will become clear from the following description of the preferred embodiments taken in conjunction with the accompanying drawings.

SUMMARY OF THE INVENTION

To this end, according to the invention, there is provided a tag attaching device having a guide groove adapted to receive and guide a tag pin assembly formed integrally from a synthetic resin, characterized by comprising a cutting means disposed to oppose to the guide groove and adapted to cut this portion of the connecting bar of the tag pin assembly from which tag pins have been severed.

DESCRIPTION OF THE PREFERRED EMBODIMENTS

Figure 2:
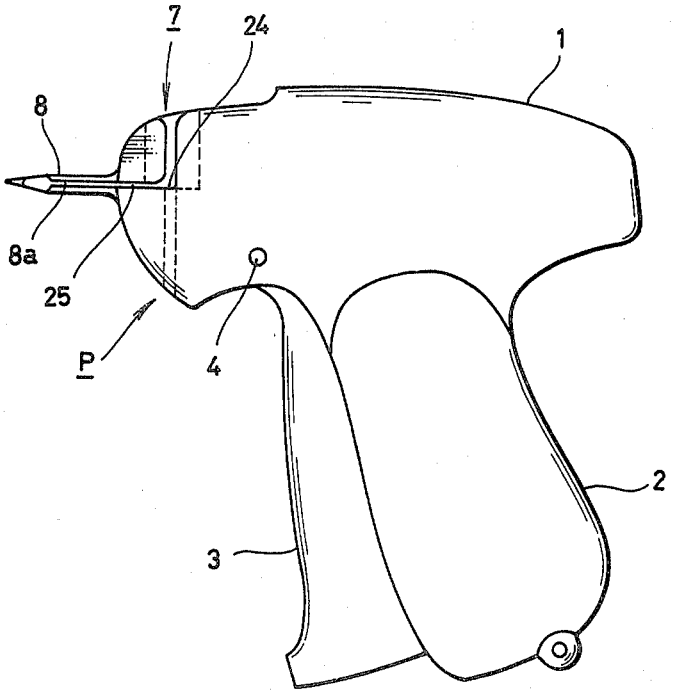
FIG. 2 is a side elevational view of a tag attaching device in accordance with the present invention.

Referring to the drawings, a tag attaching device of the invention is generally represented by a symbol P. The tag attaching device P has a main body 1 shaped from a plastic in a form like a pistol as shown in FIG. 2. As will be seen from FIG. 3, the main body 1 is constituted by a left and right half parts 101 and 102 arranged in a pair. A lever 3 is pivotally secured to the main body 1 by means of a shaft 4.

Figure 4:
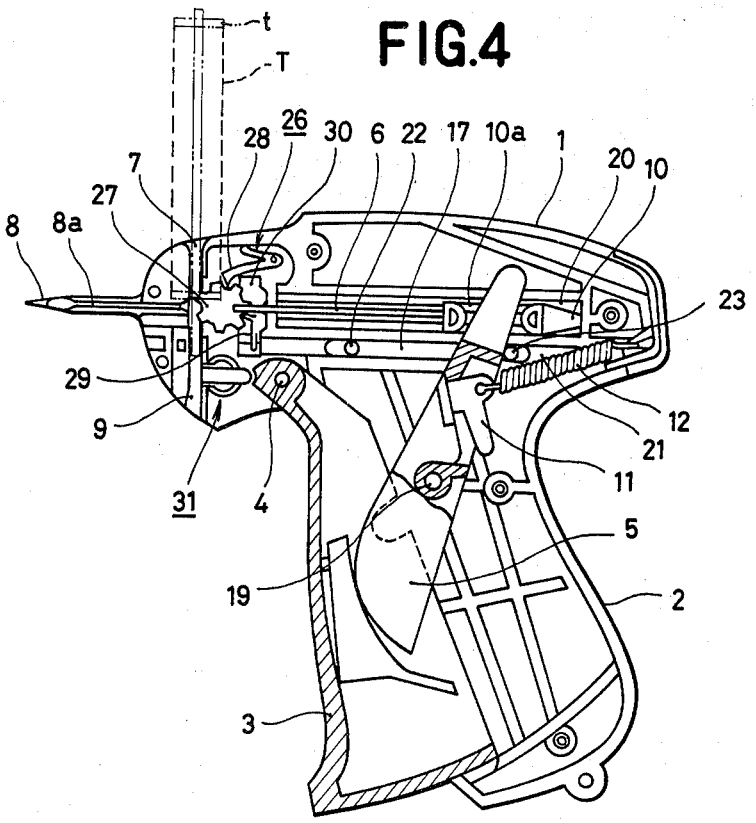
FIG. 4 is a partly sectional side elevational view of the tag attaching device shown in FIG. 2, with a half part thereof being removed.

Referring now to FIG. 4, an intermediate lever 5 is pivotally secured to a grip portion 2 of the main body 1 by means of a shaft 19. A spring 12 is mounted between a supporting member 11 provided on the intermediate lever 5 and the rear end portion of the main body 1. This spring 12 normally biases the lever 3 to project the latter outwardly from the grip portion 2 as shown in FIGS. 2 and 4.

A slider 10 is slidably disposed in a horizontal groove 20 formed in the main body 1. A push rod 6 is fixed to a front portion of the slider 10. A groove 21 formed beneath the grooves 20 and extending parallel with the latter slidably receives a cam driving member 17.

The upper end of the intermediate lever 5 is adapted to pass through an elongated slot **10*a* of the slider 10. Also, projections 22 and 23 are formed on the cam driving member at the front and rear sides of the intermediate lever 5**.

A hollow needle 8 having an elongated slot is positioned ahead of the push rod 6. The hollow needle 8 is replaceable. A guide groove 7 adapted to receive a tag pin assembly T is formed behind the hollow needle 8 so as to extend at a right angle to the latter.

Figure 3:
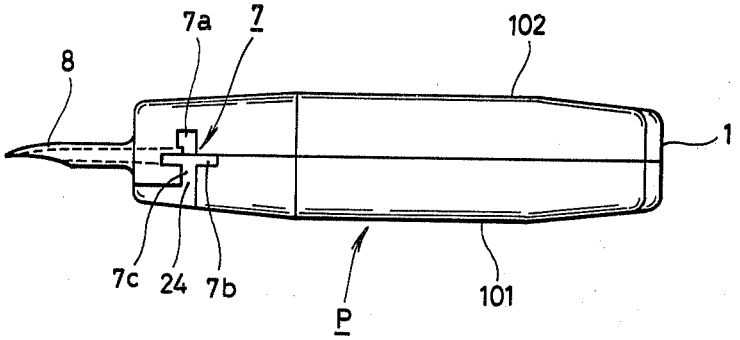
FIG. 3 is a top plan view of the tag attaching device shown in FIG. 2.

As will be seen from FIGS. 2 and 3, the upper half part of the guide groove 8 above the slot **8*a* of the hollow needle 8** has a substantially cross-like form.

Figure 1:
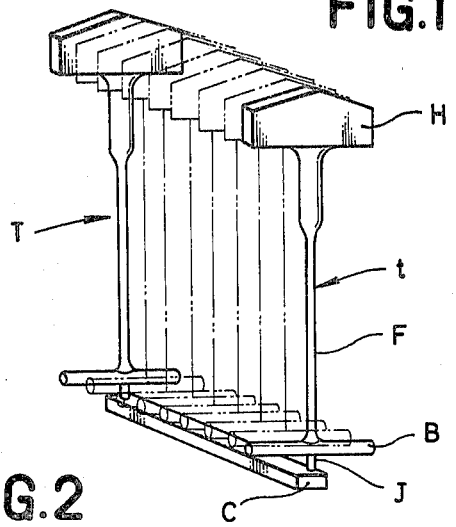
FIG. 1 is a perspective view of a tag pin assembly.

An explanation will be made hereinunder as to the construction of the tag pin assembly T with specific reference to FIG. 1. Each individual tag pin t consists of a head portion H, lateral bar B and filament portion F interconnecting the head portion H and the lateral bar B. A large number of tag pins t are arrayed at a predetermined pitch in the thicknesswise direction of the head portion H and are joined to a common connecting bar C through respective joint portions J to form a comb-like tag pin assembly T.

Referring back to FIGS. 2 and 3, reference numeral 7*a* designates a groove adapted to pass therethrough the joint portion J and the connecting rod C of the tag pin assembly T. This groove 7*a* extends through the main body 1 in the vertical direction. A reference numeral 7*b* denotes a groove adapted to receive the lateral bar B of the tag pin, while a reference numeral 7*c* designates a groove for receiving the filament portion F of the tag pin. The wall at which the groove 7*c* terminates constitutes a supporting surface 24 for supporting the filament portion F of the tag pin on the tag pin assembly T inserted into the guide groove 7. A communication groove 25 provides a communication between the slot 8*a* of the hollow needle 8 and the groove portions 7*b* and 7*c* of the guide groove 7.

A feed mechanism which is known per se is disposed behind the hollow needle 8. This feed mechanism incorporates a gear 27 disposed behind the hollow needle 8 and having teeth for meshing between adjacent joint portions J of the tag pin assembly T to guide the connecting bar C to the inlet of the slot of the hollow needle 8. A stopper 28 meshing with the teeth of the gear 27 is adapted to permit the gear 27 to rotate only in the counter-clockwise direction. Also, a feed claw 29 fixed to a movable member 30 meshes with the teeth of the gear 27 so that the gear 27 is rotated intermittently at an angular pitch corresponding to the pitch of the teeth as the movable member 30 is moved up and down. The up and downward movement of the movable member 30 is caused by a reciprocating movement of the cam driving member to the left and right, through an engagement between a cam groove formed in the side surface of the movable member 30 and a projection formed on the cam driving member 17.

A cutting mechanism 31 for cutting the connecting bar of the tag pin assembly is disposed beneath the feed mechanism 26.

Figure 5:
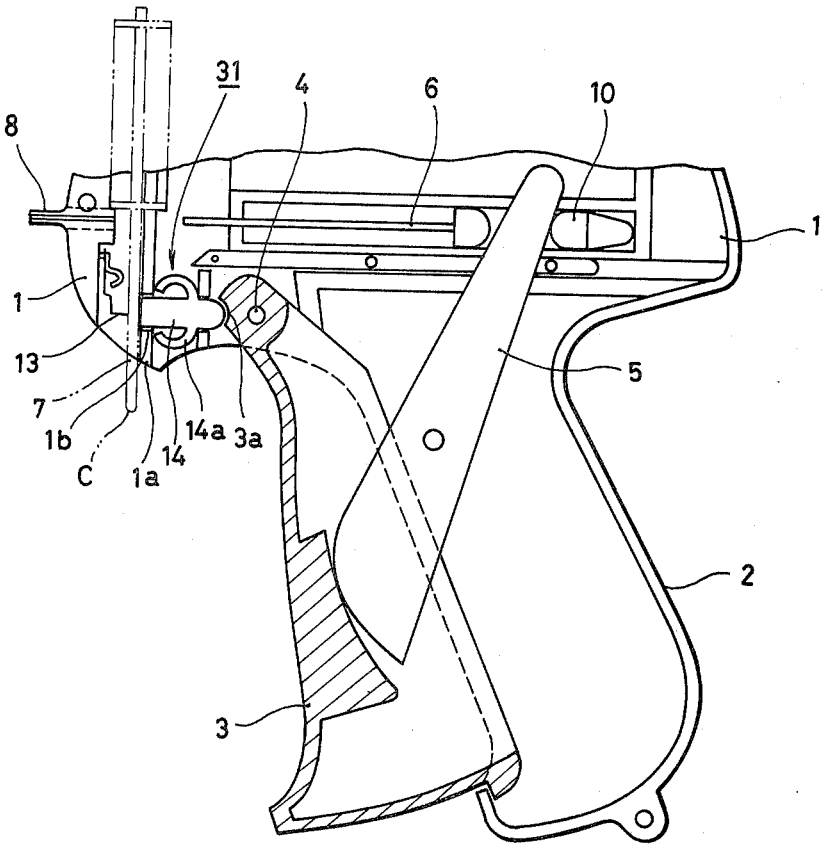
FIGS. 5 and 6 are enlarged side elevational views.

Namely, as shown in FIG. 5, a cutting edge 13 is disposed at one side and front part of the guide groove 7 to take a position under the feed mechanism 26. A pressing member 14 is fitted in a hole 1*b* formed in the wall 1*a* opposing to the cutting edge 13. The pressing member 14 is biased by a reset spring 14*a* so as not to project into the guide groove 7 normally, as shown in FIG. 5.

In the described embodiment, the pressing member 14 and the reset spring 14*a* are formed integrally from a synthetic resin having a high elasticity and strength. This, however, is not exclusive and the pressing member 14 may be formed of a metallic material.

As shown in FIG. 5, a cam portion 3*a* is formed on the upper part of the lever 3 and is made to engage with the rear portion of the pressing member 14. This arrangement is advantageous because no substantial modification of existing device is necessary.

The cutting edge 13 is integral with the cutting edge 9 for cutting the joint portions J of the tag pin assembly J. Namely, the body of the cutting edge 9 is constituted by a base portion 9*a*, side wall portion 9*b* and a bottom portion 9*c*. The cutting edge 9 is formed at the end of the side wall 9*b*, while the cutting edge 13 is formed at the end of the bottom portion 9*c*. The cutting member of this form is advantageous in both of manufacture and handling because the cutting edge for cutting the joint portions J and cutting edge for cutting the connecting bar C are formed simultaneously.

Figure 8:
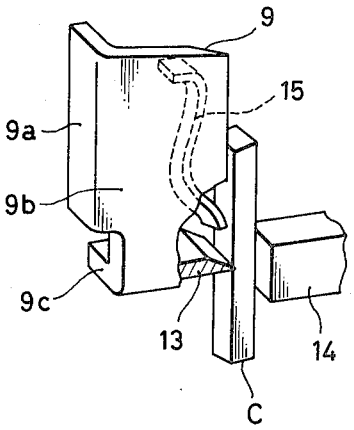
FIG. 8 is a perspective view showing the relationship between a cutting edge and a pressing member in the state before the cutting of the connecting bar.

As will be seen from FIG. 8, an elastic push-back member 15 is disposed in the vicinity of the cutting edge 13. The push-back member 15 is adapted to push back the connecting bar C which has been pressed by the pressing member 14 so as to be scored to an easy breaking or tearing, thereby to prevent the connecting bar C from being caught by the cutting edge 13.

The tag attaching device of the invention having the construction described heretofore operates in a manner explained hereinunder.

Figure 6:
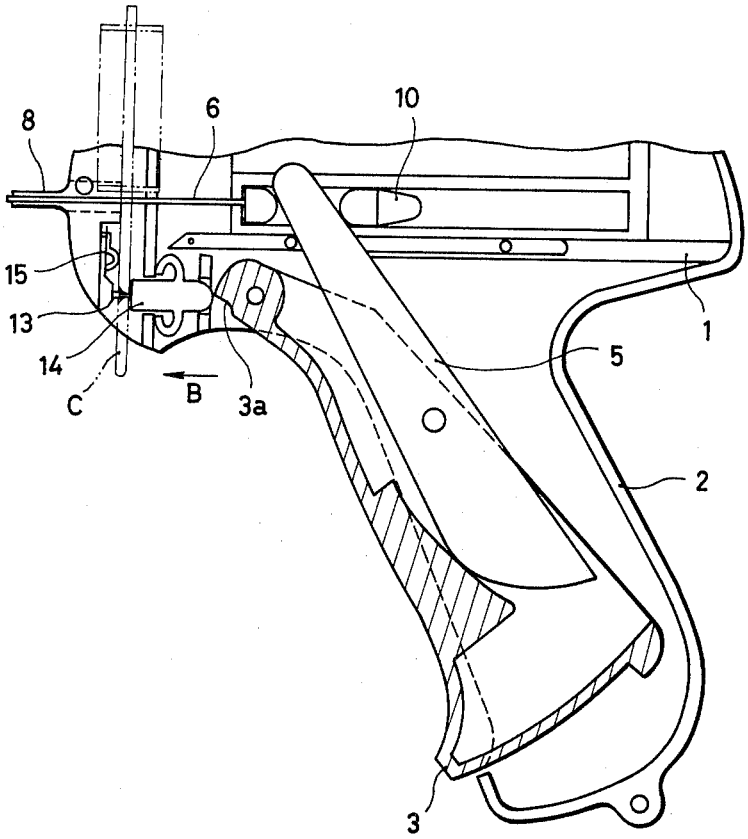
Figure 7:
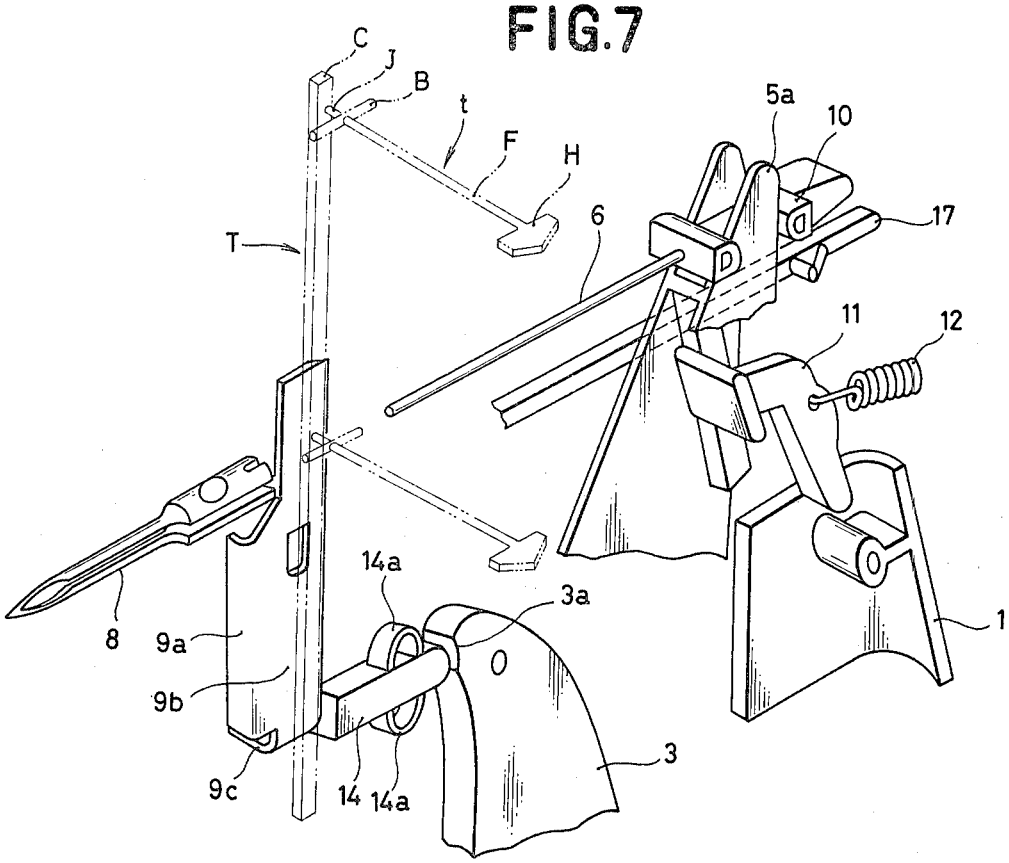
FIG. 7 is a perspective view of an essential part of the tag attaching device in accordance with the present invention.

As the lever 3 is depressed into the grip portion 2 of the main body, the intermediate lever 5 is tilted as shown in FIG. 6, so that the push rod 6 fixed to the slider 10 is driven forwardly, so that the latter forces the lateral bar B of the tag pin positioned at the inlet of slot of the hollow needle 8 into the latter. Meanwhile, the joint portion J of this tag pin is cut by the cutting edge 9 upon contact with the latter. The lateral bar B of the thus severed tag pin is then slided in the slot of the hollow needle 8 and is discharged from the end of the latter by the further movement of the push rod 6.

Since the hollow needle has been driven beforehand to penetrate the hole in the price label and the object to which the label is to be secured, the lateral bar B and a portion of the filament F are made to pass through the price label and the object as they are moved through the hollow needle 8. As a result, the price label is secured to the object by means of the tag pin t.

Meanwhile, the intermediate lever presses the projection 22 of the cam driving member 17 as it is tilted almost to the end of its stroke, thereby to drive the cam driving member 17 forwardly. As a result of the forward movement of the cam driving member 17, the movable member 30 is lifted as stated before, so that the gear 27 is rotated by one pitch of teeth by the feed claw 29.

Then, as the lever 3 is relieved from the gripping force, the intermediate lever 5, slider 10 and the cam driving member are reset to the starting positions by the force of the spring 12.

As this operation is repeated several times for attaching successive tag pins, the portion of the connecting bar C from which tag pins have been severed reach the position of the cutting mechanism 31. As explained before, this portion of the connecting bar C has a number of thorns which tend to be caught by the yarns of the garment or a like object to cause damages such as fray.

Figure 9:
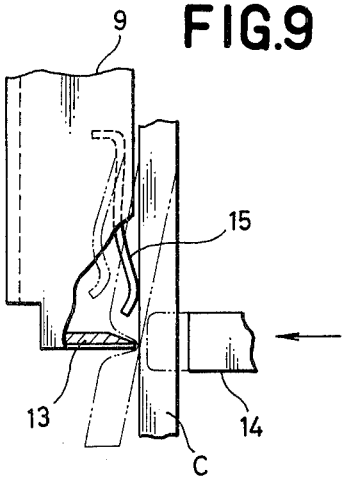
FIG. 9 is a partly cut-away side elevational view showing the state of cutting of the connecting bar.

This problem, however, is completely eliminated by the present invention, as will be understood from the following description. Namely, as the lever 3 is depressed into the grip portion 2 as shown in FIG. 6, the cam portion 3*a* formed on the upper part of the lever 3 acts to push the pressing member 14 in the direction of arrow B. In consequence, the connecting bar C of the tag pin is pressed by the pressing member 14 against the cutting edge 13 so as to be cut by the latter as illustrated by the chain line in FIG. 9.

Then, as the lever 3 is relieved from the gripping force to resume the initial position, the pressing member 14 also is reset to the starting position by the force of the reset spring 14*a*.

Figure 10:
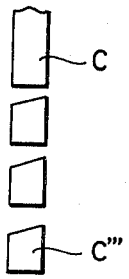
FIGS. 10A and 10B are front elevational views showing the state of cutting of the connecting bar.
Figure 10:
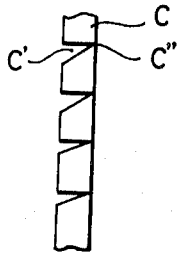

In the embodiment described heretofore, it is possible to cut the connecting bar C into small pieces C''' as in FIG. 10A. It is possible to form scores C' in the connecting bar C leaving portions C″ unsevered as shown in FIG. 10B by a suitable adjustment of the stroke of the pressing member 14, if necessary. The portion C″ can easily be severed as it is bent manually.

It is conceivable that the driving of the pressing member 14 toward the cutting edge 13 for cutting the connecting bar at each time of attaching operation may cause an unnecessary fatigue of the user of the tag attaching device.

Figure 11:
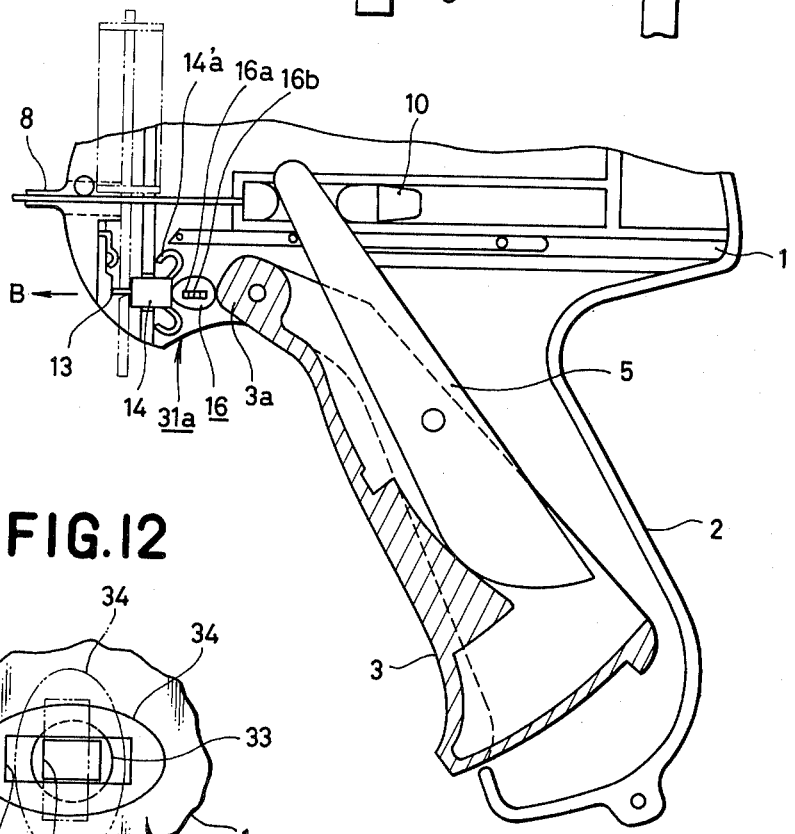
FIG. 11 is a partly sectioned side elevational view of internal structure in another embodiment of the invention.

FIG. 11 shows another embodiment improved to eliminate such a problem.

In this embodiment, a connecting member 16 is disposed between the pressing member 14′ and the cam portion 3*a* of the lever, so as to selectively intercept or transmit the pressing force exerted by the cam portion 3*a*.

Figure 12:
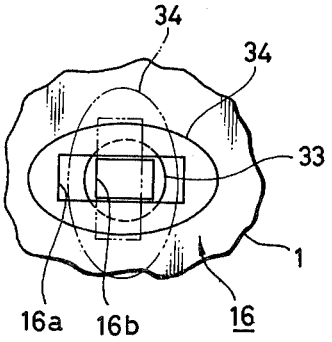
FIG. 12 is an enlarged front elevational view of a connecting body.

The connecting member 16 is composed of a shaft portion 33 and a movable member 34. The shaft portion 33 is rotatably carried by the main body 1. The shaft portion 33, however, is allowed to rotate only through 90°. The movable member 34 is slidably mounted on a supporting portion provided at the end of the shaft portion 33. As shown in FIG. 12, this movable member 34 has an oval shape and is provided with an elongated hole 16*a* extending in the direction of longitudinal axis of the movable member and adapted to receive the supporting portion 16*b*.

Therefore, as shown by the full line in FIG. 12, the cam member 3*a* presses the movable member 34 when the latter is laid, so that the movable member 34 presses the aforementioned pressing member 14′ in the direction of the arrow B thereby to cut the connecting bar C of the tag pin assembly.

However, if the movable member 34 is in the upright position as shown in FIG. 12, the cam portion 3*a* of the lever does not contact the movable member 34, so that the pressing force of the cam portion 3*a* is interrupted. In this state, therefore, it is not possible to cut the connecting bar C.

Thus, in this embodiment, it is required to lay the movable member 34 as shown by the full line in FIG. 12 only when the user wishes to cut the connecting bar C. Accordingly, the user of the tag attaching device is relieved from the fatigue.

As has been described, the present invention provides a tag attaching device having a cutting means confronting the guide groove for receiving and guiding the tag pin assembly, to permit the cutting of the connecting bar portion of the tag pin assembly after the severance of the tag pins. In consequence, various troubles such as damaging of the goods attributable to the projection of the connecting bar portion is completely eliminated.

What is claimed is:

1. In a tag attaching device for receiving an assembly of tag pins removably coupled to a connecting bar and for removing said tag pins from said connecting bar for attachment to an object, the improvement comprising a guide groove formed in said tag attaching device for guiding said assembly of tag pins through said tag attaching device and cutting means disposed proximate said guide groove for selectively cutting off portions of said connecting bar as said tag pin assembly is guided through said tag attaching device, said cutting means including a cutting edge disposed adjacent said guide groove and pressing means including a pressing member for selectively pressing said connecting bar against said cutting edge to cut off portions of said connecting bar, lever means for selectively moving said pressing member to press said connecting bar against said cutting edge, said lever means including a cam portion proximate said pressing member, and a connecting member disposed between said pressing member and said cam portion for selectively intercepting and transmitting the pressing force exerted by said cam portion to said pressing member.

2. The tag attaching device as claimed in claim 1, wherein said connecting member includes a shaft portion having a supporting portion formed on an end thereof and a movable member, said shaft portion being rotatably mounted on said tag attaching device for rotation within 90°, said movable member being slidably attached to said supporting portion of said shaft portion.

* * * * *